United States Patent [19]

Watanabe et al.

[11] 4,235,733

[45] Nov. 25, 1980

[54] ANTIBACTERIAL SOAP CONTAINING TRICHLOROHYDROXY DIPHENYL ETHER BACTERICIDE AND AN ORGANIC PHOSPHORIC ESTER AS A STABILIZER THEREFOR

[75] Inventors: Hiroshi Watanabe, Funabashi; Masatoshi Arisawa, Koganei, both of Japan

[73] Assignee: Kao Soap Co., Ltd., Tokyo, Japan

[21] Appl. No.: 56,559

[22] Filed: Jul. 11, 1979

[30] Foreign Application Priority Data

Jul. 13, 1978 [JP] Japan ..... 53-85379

[51] Int. Cl.[3] ..... C11D 9/34; C11D 9/50

[52] U.S. Cl. ..... 252/107; 252/106; 252/108; 424/340; 424/347

[58] Field of Search ..... 252/106, 107, 108, 174.16, 252/DIG. 16, DIG. 17; 424/224, 340, 347

[56] References Cited

U.S. PATENT DOCUMENTS

| | | | |
|---|---|---|---|
| 2,765,279 | 10/1956 | Nüsslein | 252/117 |
| 3,284,362 | 11/1966 | Zussman | 252/107 |
| 3,312,623 | 4/1967 | Fitch et al. | 252/106 |
| 3,346,670 | 10/1967 | Papalos | 260/980 |
| 3,625,903 | 12/1971 | Davies et al. | 252/107 |
| 3,700,601 | 10/1972 | Bloching | 252/105 |
| 3,925,227 | 12/1975 | Corey et al. | 252/106 |
| 4,111,844 | 9/1978 | Polony et al. | 252/106 |
| 4,115,295 | 9/1978 | Fearnley et al. | 252/106 |

FOREIGN PATENT DOCUMENTS 742534 12/1950 United Kingdom .

*Primary Examiner*—P. E. Willis, Jr.
*Attorney, Agent, or Firm*—Oblon, Fisher, Spivak, McClelland & Maier

[57] ABSTRACT

An antibacterial soap comprising 2,4,4′-trichloro-2′-hydroxydiphenylether in a range of 0.05 to 5% by weight and at least one organic phosphoric ester represented by the formula,

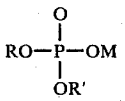

wherein R represents an alkyl group having 8 to 20 carbon atoms, or a group of

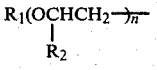

in which $R_1$ is an alkyl group having 8 to 20 carbon atoms, $R_2$ is a hydrogen atom or a methyl group, and n is an integer of 1 to 10; R′ represents the same group as R, or a hydrogen atom or an alkali metal; and M represents a hydrogen atom or an alkali metal exerts a wide range of antibacterial activities and marked resistance to discoloration upon exposure to sunlight.

3 Claims, No Drawings

ANTIBACTERIAL SOAP CONTAINING TRICHLOROHYDROXY DIPHENYL ETHER BACTERICIDE AND AN ORGANIC PHOSPHORIC ESTER AS A STABILIZER THEREFOR

BACKGROUND OF THE INVENTION

1. Field of the Invention

This invention relates to soaps suitable for skin and hair treatment and has particular reference to a novel antibacterial toilet soap which comprises 2,4,4'-trichloro-2'-hydroxydiphenylether and one or more organic phosphoric esters represented by the formula (I),

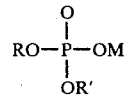

(I)

wherein R represents an alkyl group having 8 to 20 carbon atoms, or a group of

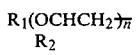

in which $R_1$ is an alkyl group having 8 to 20 carbon atoms, $R_2$ is a hydrogen atom or a methyl group, and n is an integer of 1 to 10; R' represents the same group as R, or a hydrogen atom or an alkali metal; and M represents a hydrogen atom or an alkali metal.

2. Description of the Prior Art 2,4,4'-Trichloro-2'-hydroxydiphenylether is a known compound which possesses a broad antibacterial spectrum for microorganisms such as Gram positive and negative bacteria, mold, yeast and the like. Moreover, the compound exhibits substantially reduced toxic and irritating effects upon the skin and mucous membrane of human beings. Because of such substantial advantages, the compound is useful as a good antibacterial agent for inhibiting any noxious microorganisms which would adhere to the skin and hair, and therefore, can be expected to find wide application to soaps, shampoos, detergents, cosmetics, ointments and similar articles.

However, such antibacterial compound or 2,4,4'-trichloro-2'-hydroxydiphenylether is encountered with the drawback that the compound when incorporated into any conventional soap bases causes the resulting soaps to discolor or become dark brown when they are exposed to sunlight. Although discoloration in the soaps does not induce adverse affects upon the anti-bacterial action of the compound, nevertheless it mars attractive appearance of the soap product and makes the user feel uneasy. This problem is detrimental to commercial acceptance of generally light-colored soaps. Accordingly, a need continues to exist for an antibacterial toilet soap which produces no color deterioration even upon exposure to sunlight.

In fact, various attempts have been made to reduce, retard or prevent discoloration in the soaps of the type described, and some reports on the problem have been made public. According to U.S. Pat. No. 3,284,362, an aromatic carboxylic acid or an alkali metal salt thereof is employed as a discolor-preventing agent in a soap composition. The use of a $C_8$–$C_{22}$ substantially straight-chain fatty acid is disclosed in U.S. Pat. No. 3,625,903 and Japanese Patent Publication No. 47-20629. On the other hand, Japanese Patent Publication No. 52-43207 is concerned with color stabilization with the aid of organic acids such as malonic acid, citric acid and malic acid. It has now been found that satisfactory results cannot still be obtained by such prior art techniques.

The present inventors have made many studies concerning minimizing or avoiding color formation or discoloration in a variety of antibacterial soaps into which 2,4,4'-trichloro-2'-hydroxydiphenylether is incorporated. As a result of these studies, they have discovered that particular organic phosphorous compounds having the formula (I) exhibit excellent discolor-preventing characteristics and are suprisingly efficient in preventing the soaps from discoloration. The present invention bases its achievement upon this discovery.

SUMMARY OF THE INVENTION

It is an object of the present invention to provide a novel antibacterial soap which eliminates the above noted drawbacks of the existing antibacterial soaps.

Another object of the invention is to provide a novel antibacterial soap which provides a wide range of antibacterial activities and is protected against discoloration upon exposure to sunlight and which is very stable in physical properties and does not irritate the skin.

In accordance with this invention, there is provided an antibacterial soap which comprises 2,4,4'-trichloro-2'-hydroxydiphenylether in a range of 0.05 to 5% by weight and at least one organic phosphoric ester represented by the formula (I),

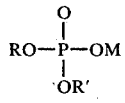

(I)

wherein R represents an alkyl group having 8 to 20 carbon atoms, or a group of

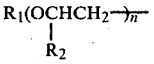

in which $R_1$ is an alkyl group having 8 to 20 carbon atoms, $R_2$ is a hydrogen atom or a methyl group, and n is an integer of 1 to 10; R' represents the same group as R, or a hydrogen atom or an alkali metal; and M represents a hydrogen atom or an alkali metal.

These and other objects and advantages of the invention will become apparent from the detailed description and claims which follow hereinafter.

By the term soap is meant a cleansing agent in the form of bars and flakes.

Unless otherwise indicated, all percentages are by weight in the specification.

DETAILED DESCRIPTION OF PREFERRED EMBODIMENTS

Broadly stated, a novel antibacterial soap according to the present invention is produced by incorporating into a solid or powdered soap base 2,4,4'-trichloro-2'-hydroxydiphenylether as an antibacterial agent and at least one organic phosphate ester of the formula (I) as a discolor-preventing agent.

Typical examples of organic phosphate esters which are useful in the invention include monolaurylphosphoric acid, dilaurylphosphoric acid, mono-polyoxyethylene(3)laurylphosphoric acid, dipolyoxyethylene(3-

)laurylphosphoric acid, disodium monopalmitylphosphate, monomyristyl phosphoric acid, mono-polyoxyethylene(10)myristylphosphoric acid, di-polyoxyethylene(10)myristylphosphoric acid, and disodium mono-polyoxyethylene(10)myristylphosphate. Of these phosphoric esters, particularly desirable are monoalkylphosphate esters wherein R is an alkyl group having 8 to 20 carbon atoms, and R' and M are each hydrogen atoms in the formula (I).

The amount of the antibacterial compound or 2,4,4'-trichloro-2'-hydroxydiphenylether may vary, depending on the intended function of the soap, and is practically in a range of the about 0.05 to 5%. The discolor-preventing or organic phosphoric ester may be incorporated in a range of about 0.1 to 20%, preferably 0.5 to 5%. The addition of the discolor-preventing agent in smaller amounts of less than the lower limit fails to impart sufficient color stability to the soap, whereas larger amounts of more than the upper limit show no appreciable increase in the effectiveness and adversely affects the physical properties of the soap, thereby resulting in cracked or otherwise deteriorated soap product. Consequently, the discolor-preventing compound should be added within the specified range in order to obtain the desired results.

Other ingredients can be advantageously utilized together with the antibacterial and discolor-preventing agents in the antibacterial soap of this invention. Such ingredients are germicides, anti-inflammatory agents, foaming additives, antioxidants, perfumes and pigments and may be included individually or in combination in any convenient manner.

Suitable germicides include 3,4,4'-trichlorocarbanilide (TCC) and 3-trifluoromethyl-4,4'-dichlorocarbanilide ($CF_3$). Suitable anti-inflammatory agents include 5-ureidohydantoin (allantoin), dipotassium glycyrrhetate and diammonium glycyrrhetate. Suitable foaming additives include superfatting agents such as lanolin, lanolin derivatives, fatty acids, fatty acid esters and higher alcohols, and alkylalkanolamides. Further, suitable antioxidants include butylated hydroxytoluene, butylated hydroxyanisole, tocopherol, and L-ascorbic acid and esters or salts thereof.

This invention will be described in more detail with reference to some Examples which indicate preferred embodiments of the invention by way of illustration only.

EXAMPLE I

Antibacterial soaps were prepared by combining and mixing the following ingredients in the usual manner known in the art. After exposure to direct sunlight for 5 days in the midsummer, the soaps were observed for any varying degrees of discoloration. A soap made in a similar fashion but unexposed and kept in dark cooled conditions was used as a standard of comparison.

The results obtained are shown in Table 1.

| Soap Formulation: | |
|---|---|
| Soap base | 100.0 g |
| Titanium dioxide | 0.1 g |
| Chelating agent (EDTA-4Na) | 0.1 g |
| 2,4,4'-Trichloro-2'-hydroxy-diphenylether | 0.5 g |
| Discolor-preventing agent | 0.5 g |

TABLE 1

| Test Soaps | Discolor-preventing Agents: R in Formula (I) | R' in Formula (I) | M in Formula (I) | Grades |
|---|---|---|---|---|
| Present Soaps | Lauryl | Hydrogen | Hydrogen | 3 |
| | Lauryl | Lauryl | Hydrogen | 4 |
| | Polyoxyethylene (3) lauryl | Hydrogen | Hydrogen | 3 |
| | Polyoxyethylene (3) lauryl | Polyoxyethylene (3) lauryl | Hydrogen | 4 |
| | Palmityl | Sodium | Sodium | 4 |
| Comparative Soaps | Lauric acid | | | 10 |
| | Succinic acid | | | 7 |
| | Citric acid | | | 7 |
| Control | Not added | | | 10 |

| Grading Notations of Discoloration: | |
|---|---|
| 0: Not discolored or equal to the standard<br>1:<br>2: Discolored to a substantially small degree as compared to the standard<br>3:<br>4: Slightly discolored as compared to the standard | Commercially acceptable |
| 5:<br>6: Considerably discolored as compared to the standard | Commercially questionable |
| 7:<br>8: Extremely discolored as compared to the standard<br>9:<br>10: Wholly discolored or equal to the control | Commercially unacceptable |

EXAMPLE II

Antibacterial soaps were prepared in the same procedure as in Example I and tested to observe the relationship between the varying ratios of the discolor-preventing agents present in the soaps and the degrees of color stabilization and cracking.

The results obtained are shown in Table 2.

TABLE 2

| Discolor-preventing Agents (monomyristyl Phosphoric Acid) | Grades of Color Stabilization | Degrees or Grades of Cracking |
|---|---|---|
| 0 % | 10 | 0 |
| 0.05 | 7 | 0 |
| 0.1 | 4 | 0 |
| 0.5 | 3 | 0 |
| 1 | 0 | 0 |
| 5 | 0 | 0 |
| 10 | 0 | 1 |
| 20 | 0 | 1 |
| 30 | 0 | 4 |

Test Method of Cracking

Test pieces each having a dimension of 1 cm×1 cm×5 cm were cut out of the central portions of the soaps. Each cut was provided at one angular portion thereof with a thin metal wire and suspended by means of the wire in a test tube containing 40 ml of distilled water such that the cut was immersed in the water. Immersion was continued for 3 hours at a temperature of 10° C.±1° C. Thereafter, the cut was taken out of the test tube and allowed to stand for 24 hours at room temperature. The degrees of cracking in the test pieces thus treated were observed and graded.

Grading Notations of Cracking

0: Not cracked
1: Slightly cracked
2: Cracked with one relatively large stripe
3: Cracked with more than two relatively large stripes
4: Cracked with considerably large stripes on all sides
5: Cracked with much more stripes than grade 4

EXAMPLE III

Into a solid soap composition containing 100 g of a soap base, 0.1 g of titanium dioxide, 0.1 g of sodium ethylenediaminetetraacetate and 1.0 g of a perfume were incorporated 5 g of 2,4,4'-trichloro-2'-hydroxydiphenylether, 1.5 g of monolaurly phosphoric acid and 1.5 of monosodium mono(polyoxyethylene(3)lauryl phosphate. The thus obtained soap was exposed to light for 24 hours in a sunshine weather meter with the results that no color formation developed in the soap.

Although this invention has been described with reference to certain specific Examples, it will be manifest to those versed in the art that various changes and modifications may be made within the spirit and scope of the appended claims.

What is claimed is:

1. An antibacterial soap comprising 2,4,4'-trichloro-2'-hydroxy-diphenylether in a range of 0.05 to 5% by wt. and at least one organic phosphoric ester represented by the formula:

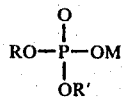

wherein R represents an alkyl group having 8 to 20 carbon atoms, or a group of

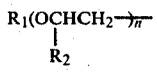

in which $R_1$ is an alkyl group having 8 to 20 carbon atoms, $R_2$ is a hydrogen atom or a methyl group, and n is an integer of 1 to 10; $R^1$ represents the same group as R, or an hydrogen atom or an alkali metal; and M represents a hydrogen atom or an alkali metal; and wherein said organic phosphoric ester is added in a range of 0.1 to 20% by weight.

2. The antibacterial soap according to claim 1 wherein said organic phosphoric ester is a monoalkylphosphoric ester having 8 to 20 carbon atoms.

3. The antibacterial soap according to claim 1, wherein said organic phosphoric ester is added in a range of 0.5 to 5% by weight.

* * * * *